United States Patent [19]

Yuzawa

[11] Patent Number: 4,593,668

[45] Date of Patent: Jun. 10, 1986

[54] INJECTION RATE CONTROLLER FOR FUEL INJECTION PUMP

[75] Inventor: Yasutaka Yuzawa, Higashi-Matsuyama, Japan

[73] Assignee: Diesel Kiki Co., Ltd., Tokyo, Japan

[21] Appl. No.: 779,094

[22] Filed: Sep. 23, 1985

[30] Foreign Application Priority Data

Sep. 23, 1984 [JP] Japan ..... 59-199310

[51] Int. Cl.[4] ..... F02M 59/20

[52] U.S. Cl. ..... 123/496; 123/506; 123/503; 123/449; 417/304; 417/289

[58] Field of Search ..... 123/496, 506, 449, 503, 123/458, 387; 417/282, 289, 304, 288

[56] References Cited

U.S. PATENT DOCUMENTS

| | | | |
|---|---|---|---|
| 3,620,647 | 11/1971 | Hofer | 417/304 |
| 3,827,832 | 8/1974 | Faupel | 417/289 |
| 4,164,921 | 8/1979 | Hofer | 123/506 |
| 4,211,203 | 7/1980 | Kobayashi | 123/503 |
| 4,271,808 | 6/1981 | Kobayashi | 417/304 |
| 4,407,253 | 10/1983 | Bauer | 123/506 |
| 4,449,504 | 5/1984 | Furuhashi | 123/503 |
| 4,510,908 | 4/1985 | Eisele | 123/506 |
| 4,537,170 | 8/1985 | Yamada | 417/289 |
| 4,542,725 | 9/1985 | Yasuhara | 123/449 |

FOREIGN PATENT DOCUMENTS 0134222 10/1979 Japan ..... 123/449

*Primary Examiner*—Carl Stuart Miller

*Attorney, Agent, or Firm*—Wenderoth, Lind & Ponack

[57] ABSTRACT

An injection rate controller for a fuel injection pump comprises first and second valve ports formed in a pump housing so as to communicate with each other through a connection aperture, a spool valve movably accommodated within the first valve port and adapted to form communication between the first valve port and a high pressure chamber through a communication aperture under a specific condition of engine drive, a pressure control valve having its cross section contracted gradually in its axial direction and accommodated within the second valve port so as to be reciprocative in synchronism with a plunger, and a spill channel formed in the pump housing for connecting the second valve port on a fuel exhaust side to a pump house, whereby part of high pressure fuel within the high pressure chamber is guided, under the specific condition of engine drive, successively to the communication aperture, first valve port, connection aperture and second valve port, and is caused to escape into the pump house through the spill channel.

6 Claims, 9 Drawing Figures

INJECTION RATE CONTROLLER FOR FUEL INJECTION PUMP

BACKGROUND OF THE INVENTION

1. Field of the Invention

The present invention relates to an injection rate controller for a fuel injection pump, which is adapted to lower the noise level under a specific condition of engine drive such as at engine idle, for example.

2. Description of the Prior Art

The fuel injection rate of a fuel injection pump mounted on a diesel engine, i.e. the injection quantity per unit crank angle, is substantially determined by the diameter of a plunger and the profile of a face cam in case where the pump is of a distributor type. Since the injection rate cannot be controlled even though the operation conditions are optionally set, when fuel supplied under pressure from the fuel injection pump is injected through an injection nozzle into a combustion chamber and combusted therewithin, the initial injection rate becomes high and the combustion speed becomes temporarily high to thereby heighten the heat generation rate and increase the noise level. The tendency to these adverse phenomena is markedly developed under idle operation such as at the time of warm-up. Particularly, during the wintertime, the engine noise reaches a high level. Therefore, it has been desired to reduce or eliminate the drawbacks suffered by the conventional engines.

There has heretofore been proposed an injection rate controller capable of varying the fuel injection rate by causing part of the fuel sucked in the interior of a plunger to escape into a pump house in response to the engine load conditions. For example, U.S. Pat. No. 4,413,600 discloses a distributor type fuel injection pump which comprises a plunger having first and second cut-off ports opening in the peripheral surface thereof and communicating with a high pressure chamber, a control sleeve adapted to open and close the cut-off ports and provided in the peripheral surface thereof with a plurality of spill ports smaller in number than the cylinders of an engine, the spill ports being normally stopped up and, at engine idle, being successively communicated with the second cutoff port to cause part of the fuel pressurized within the high pressure chamber to escape into a pump house, whereby low injection rate at engine idle can be secured. This prior art, however, necessitates formation of the first and second cut-off ports in the plunger and a plurality of spill ports in the control sleeve and, therefore, entails a problem that complicated and troublesome processing should be effected relative to the plunger and the control sleeve.

OBJECTS AND SUMMARY OF THE INVENTION

One object of the present invention is to provide an injection rate controller for a fuel injection pump, which is capable of improving the conventional problems, controlling with exactitude the fuel injection rate in response to the state of engine drive, being actuated with high stability and high reliability, and lowering the noise level of an engine under its specific operation condition.

Another object of the present invention is to provide an injection rate controller for a fuel injection pump, which is simple in construction and easy to manufacture.

To attain the objects described above, according to the present invention, there is provided an injection rate controller for a fuel injection pump, which comprises first and second valve ports formed in a pump housing so as to communicate with each other, a spool valve movably accommodated within the first valve port and adapted to form communication between the first valve port and a high pressure chamber under a specific condition of engine drive, a pressure control valve having its cross section contracted gradually in its axial direction, and accommodated within the second valve port so as to be reciprocative in synchronism with a plunger, and a spill channel formed in the second valve port on a fuel exhaust side so as to communicate with a pump house.

The above and other objects, characteristic features and advantages of the present invention will become apparent to those skilled in the art as the disclosure is made in the following description of a preferred embodiment of the invention, as illustrated in the accompanying drawings.

BRIEF DESCRIPTION OF THE DRAWINGS

FIG. 5(*b*) is a graph illustrating characteristic curves of the relation between the internal pressure of a plunger chamber and the crank angle.

FIG. 5(*c*) is a graph illustrating characteristic curves of the relation between the injection rate and the crank angle.

DETAILED DESCRIPTION OF THE PREFERRED EMBODIMENT

The present invention will now be described in detail with reference to the illustrated embodiment as applied to a distributor type fuel injection pump.

Figure 1:
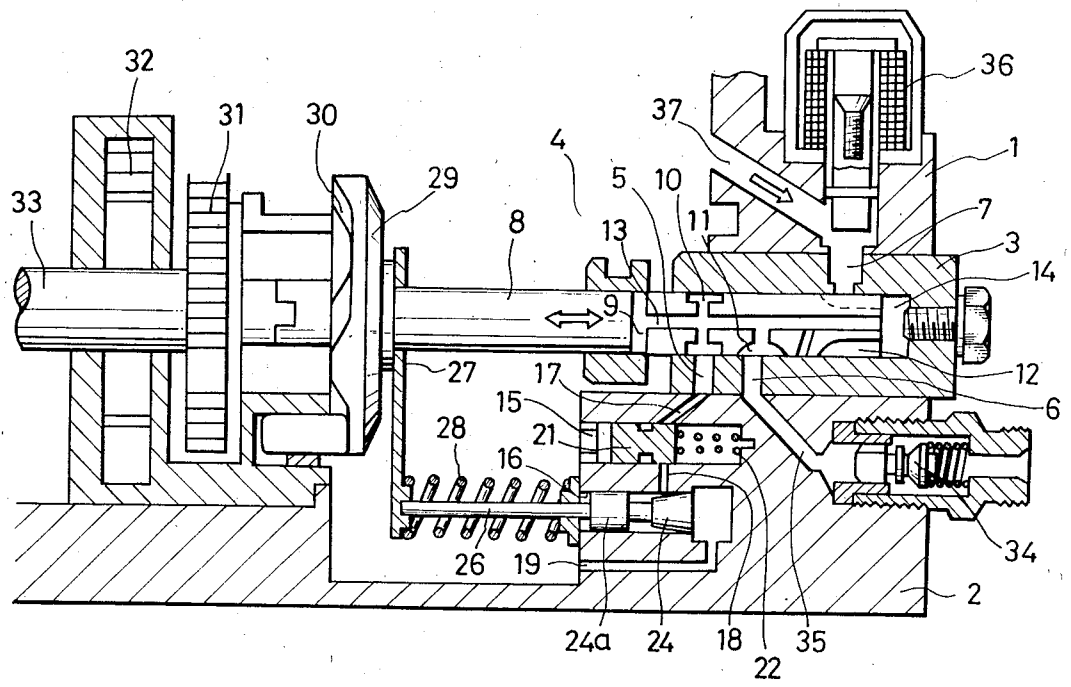
FIG. 1 is a longitudinal cross section illustrating a distributor type fuel injection pump utilizing one embodiment of an injection rate controller according to the present invention, with a governor mechanism omitted.
Figure 2:
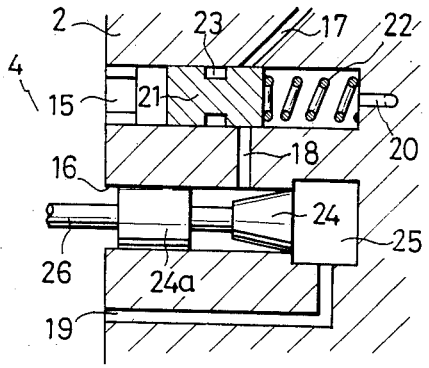
FIGS. 2(*a*), 2(*b*) and 2(*c*) are explanatory sectional views illustrating the states assumed when valves used in the embodiment are actuated.
Figure 2:
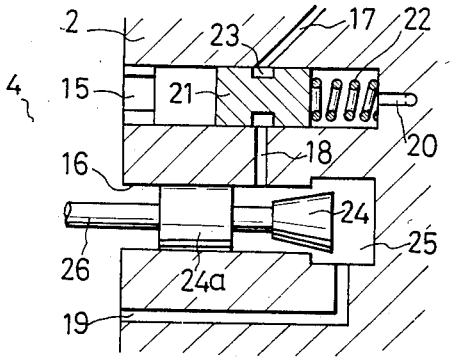
Figure 2:
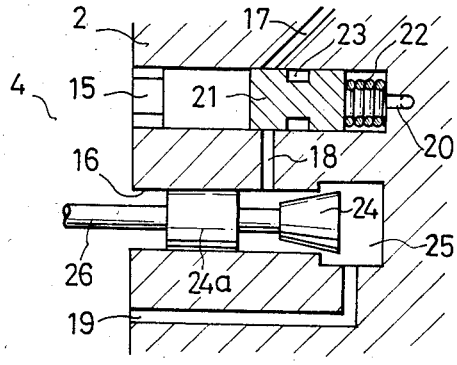

FIGS. 1 and 2 illustrate one embodiment of an injection rate controller for a fuel injection pump according to the present invention. Denoted by reference numeral 1 is a hydraulic head of a pump housing 2, in which a hollow cylindrical plunger barrel 3 is securely mounted. The plunger barrel 3 has a bypass port 5, a distribution port 6 and an intake port 7 all opening in the peripheral surface thereof and disposed in the order mentioned as viewed from the side of a pump house 4 in FIG. 1. Within the hollow portion in the plunger barrel 3 is slidably accommodated a rotatable plunger 8 which has a cut-off port 9, an equalizer slit (not shown), an annular bypass slit 10, a distribution slit 11 and an intake slit 12 formed in the peripheral surface thereof and has also formed therein a center channel 13 which communicates with the port 9 and the slits 10 and 11 and has its one open portion communicating with a high pressure chamber 14 (plunger chamber).

The pump housing 2 has first and second valve ports 15 and 16 formed therein as separated in height from each other. The first valve port 15 has one end thereof opening to the pump house 4 and communicates with the bypass port 5 of the plunger barrel 3 via an oblique communication aperture 17 and with the second valve port 16 via a connection aperture 18. The bottom wall of the first valve port 15 communicates with a passageway 20 which leads to a low pressure side. The second valve port 16 has one end thereof opening to the pump house 4 similarly to the first valve port 15 and the other end thereof connected to an oil chamber 25 which communicates with the pump house 4 via an spill channel 19.

The first valve port 15 has a spool valve 21 slidably accommodated therein. The spool valve 21 is biased to the side of the pump house 4 by a spring 22 interposed between its end face and the bottom wall of the first valve port 15 and is set movable against the resilience of the spring 22 by the action of oil pressure in the pump house 4 into which fuel is fed. The spool valve 21 has an annular control port 23 formed in the periphery thereof. The control port 23 is adapted to form communication between the communication aperture 17 and the connection aperture 18 only when an engine is driven under a specific condition such as at engine idle, for example. That is to say, the spool valve 21 is displaced rightward in FIG. 1 by the action of the oil pressure in the pump house 4 and, only at engine idle, enables the control port 23 to be positioned at the openings of the communication aperture 17 and the connection aperture 18 to communicate these apertures with each other.

The second valve port 16 has a pressure control valve 24 movably accommodated therein. The pressure control valve 24 is formed in the shape of a truncated cone having its largest sectional area substantially conforming to the sectional area of the second valve port 16. The pressure control valve 24 has its bottom surface of the largest area directed to the oil chamber 25 and its top surface connected integrally with the leading end of a valve shaft 26 which is set reciprocative within the second valve port 16 in synchronism with the reciprocation of the plunger 8 as will be described afterward. The reciprocation of the valve shaft 26 varies the opening area of the pressure control valve 24 at a throttle portion which is the boundary between the second valve port 16 and the oil chamber 25, thereby fulfilling the function of the pressure control valve 24 and making variable the quantity of oil fed from the oil chamber 25 to the spill channel 19. The valve shaft 26 serves also as a plunger spring shaft and has its portion in the vicinity of the pressure control valve 24 provided with a valve guide 24*a* and its base end fixed to the leading end of an arm 27 attached to the plunger 8.

In FIG. 1, reference numeral 28 denotes a plunger spring attached to the valve shaft 26, 29 a cam disk, 30 a face cam, 31 a gear, 32 a feed pump, 33 a drive shaft, 34 a delivery valve, 35 an outlet passageway communicating with the distribution slit 6 and the delivery valve 34, 36 a fuel cut-off solenoid, and 37 a fuel passageway communicating the pump house 4 and the intake port 7.

Figure 3:
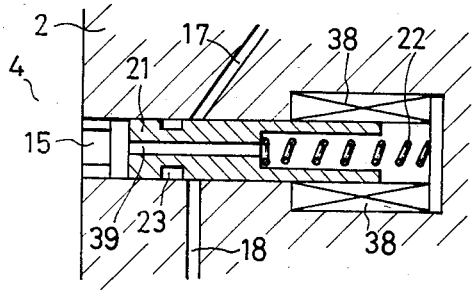
FIG. 3 is a cross section illustrating another example of one of the valves, usable in the present invention.
Figure 4:
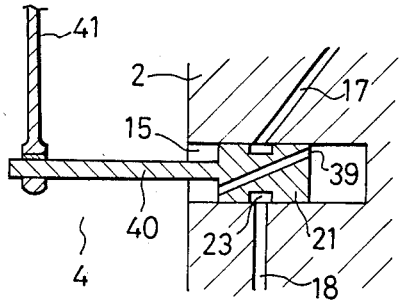
FIG. 4 is a cross section illustrating still another example of the valve, usable in the present invention.

FIGS. 3 and 4 illustrate other examples of the spool valve 21 usable for the purpose of the present invention. The portions of each of these examples identical with or similar to those of the spool valve 21 of FIGS. 1 and 2 are indicated by the same reference numerals as used in FIG. 1 or FIG. 2.

In the example of FIG. 3, an annular magnet coil 38 is fitted around the bottom portion of the first valve port 15 so that it can attract the spool valve 21 when being excited under a specific condition of engine drive such as at engine idle, for example. An input signal to the magnet coil 38 is preset by suitably determining conditions such as the rpm of an engine, load, position of a control lever, etc. At engine idle, therefore, the magnet coil 38 is excited to attract the spool valve 21, with the result that the communication aperture 17 and the connection aperture 18 are communicated with each other through the control port 23 formed in the spool valve 21. The spool valve 21 can thus be stably actuated with exactitude. Denoted by reference numeral 39 in FIG. 3 is a through hole formed in the spool valve 21 for connecting two compartments of the first valve port 15 partitioned by the spool valve 21 to maintain the compartments under the same pressure.

FIG. 4 illustrates another example of spool valve 21 which has an integral connection lever 40 projecting toward the side of the pump house 4. To the leading end of the connection lever 40 is fixed one end of a lever 41 such as a control lever interlocked with an axle pedal, a governor lever moved in response to the rotation speed of the injection pump, or the like lever. A through hole 39 similar to that shown in FIG. 3 is formed in the spool valve 21 in this example. In this case, the spool valve 21 is displaced by means of the lever 41 under a specific condition of engine drive to form communication between the communication aperture 17 and the connection aperture 18 via the control port 23. Thus, the actuating mechanism of this spool valve is simplified.

In the injection rate controller having the construction as described above, at engine stop, i.e. at the time the fuel injection pump is subjected to its standstill state, no fuel is fed under pressure from the feed pump 32 to the pump house 4. That is to say, the pump house 4 is maintained under substantially zero pressure. At this time, therefore, the interior of the first valve port 15 is in the state shown in FIG. 2(*a*). To be specific, the spool valve 21 is biased to the pump house 4 by the resilience of the spring 22 larger than the pressure in the pump house 4 and stops up at its peripheral surface the openings of the communication aperture 17 and the connection aperture 18. On the other hand, the plunger 8 stops its movement in the standstill state of the fuel injection pump, and the valve shaft 26 interlocked synchronously with the plunger 8 also stops its movement. Therefore, the pressure control valve 24 connected integrally with the valve shaft 26 is in its standstill position as illustrated in FIG. 2(*a*).

When the engine is started and the fuel injection pump is driven to feed under pressure fuel from the feed pump 32 to the interior of the pump house 4, the internal pressure of the pump house 4 becomes larger and larger and acts on the end face of the spool valve 21. Therefore, the spool valve 21 is urged rightward in FIG. 2(*a*) against the resilience of the spring 22 by the internal pressure of the pump house 4. When the internal pressure of the pump house 4 has reached a prescribed level at which the engine idles, the spool valve 21 stops moving at a position at which the control port 23 of the spool valve 21 communicates with both the communication aperture 17 and the connection aperture 18. As a result, the two apertures 17 and 18 communicate with each other through the control port 23 as shown in FIG. 2(*b*).

At engine idle, as described above, the fuel supplied into the intake port 7 and intake slit 12 through the fuel supply channel 37 from the pump house 4 and then sucked in the high pressure chamber 14 and center channel 13 is delivered, during the injection stroke of the plunger 8, into the delivery valve 34 successively through the distribution slit 11, distribution port 6 and outlet pressure channel 35 and then injected through an injection nozzle (not shown) into a combustion chamber of the engine.

On the other hand, part of the high pressure fuel is guided during the aforementioned injection stroke into the control port 23 successively through the center channel 13, bypass slit 10, bypass port 5 and communication aperture 17. Since the control port 23 has already communicated with the connection aperture 18, as described above, the high pressure fuel is guided into the connection aperture 18 and introduced into the second valve port 16. The pressure control valve 24 is set movable in synchronism with the plunger 8 and, at the termination of the suction stroke in the returning movement of the reciprocating plunger 8, has its largest sectional portion (bottom end face of a truncated cone) positioned at the throttle portion as shown in FIG. 2(*a*). At this time, the pressure control valve 24 maintains its closed state. As soon as the reciprocating plunger 8 starts its forward movement into the injection stroke, the valve shaft 26 fixed to the arm 27 is moved in synchronism with the plunger 8, i.e. in the rightward direction in FIG. 2(*a*). For this reason, the largest-area end face of the pressure control valve 24 becomes apart from the aforementioned throttle portion and enters the oil chamber 25, thereby communicating the second valve port 16 with the spill channel 19 through the oil chamber 25. As a result, the high pressure fuel having flowed into the second valve port 16 advances into the oil chamber 25 and escapes into the pump house 4 through the spill channel 19.

Figure 5:
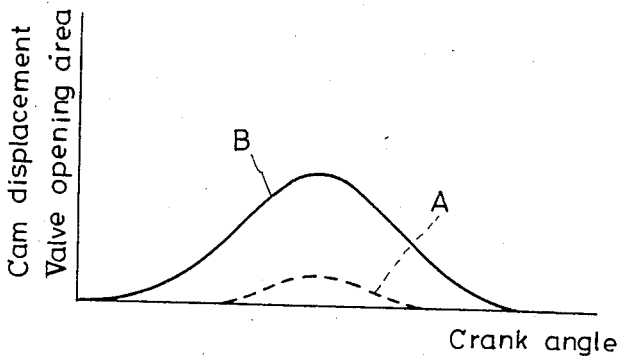
FIG. 5(*a*) is a graph illustrating characteristic curves of the relation among the valve opening area, cam displacement and crank angle.
Figure 5:
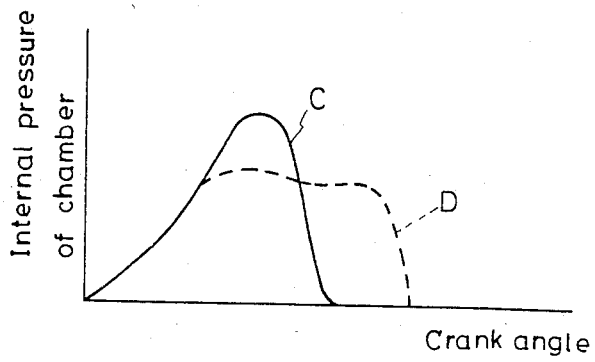
Figure 5:
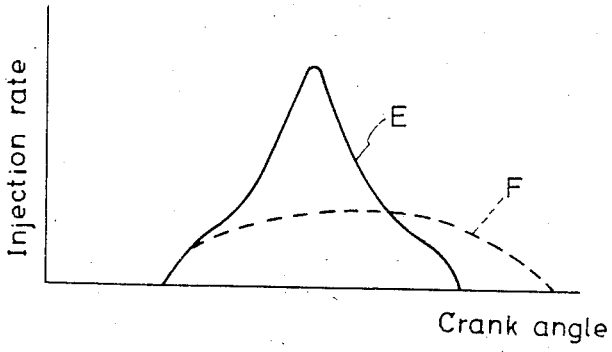

Since, at engine idle, the pressure within the pump house 4 is substantially equal to the resilience of the spring 22 and the spool valve 21 is located at a fixed position within the first valve port 15 as illustrated in FIG. 2(*a*), the quantity of the high pressure fuel introduced into the second valve port 16 is constant. The valve opening area at the throttle portion defined by the conical surface of the pressure control valve 24 and the boundary between the second valve port 16 and the oil chamber 25 gradually increases in proportion to the amount of the forward displacement of the reciprocating plunger 8, thereby gradually increasing the quantity of the oil fed to the spill channel, comes to the maximum at the termination of the forward displacement of the plunger 8, and gradually decreases in proportion to the amount of the return displacement of the plunger 8. Thus, the valve opening area has a mountain-shaped characteristic curve A as shown in FIG. 5(*a*). This characteristic curve A substantially approximates to a cam lift (displacement) curve of the cam disk 29 shown by B in FIG. 5(*a*).

At engine idle, the high pressure chamber 14 and the center channel 13 are communicated with the pump house 4 through the opening of the second valve port 16 whose opening area is increased in response to the forward movement of reciprocating plunger 8 and, therefore, a rise in pressure of the injection fuel, i.e. in internal pressure of the high pressure chamber 14, is suppressed. As a result, the low pressure state is maintained for a fixed period of time. Specifically, in the low pressure state, a fuel injection pump not having a controller capable of making the escape amount of fuel variable in response to the forward movement of the plunger has a steep mountain-shaped pressure characteristic curve C shown by the solid line in FIG. 5(*b*), whereas that having the injection rate controller of the present invention has a pressure characteristic curve D having a flat portion over a wide range of the injection stroke of the plunger as shown by the phantom line in FIG. 5(*b*). Therefore, the injection rate, i.e. the injection quantity per unit crank angle, of the fuel injection pump not having the aforementioned controller exhibits a steep mountain-shaped characteristic curve E and, in the present invention, the injection rate exhibits a characteristic curve F of a gently sloped mountain shape as a whole, as illustrated in FIG. 5(*c*). This indicates that the low injection rate is maintained according to the present invention.

Accordingly, the combustion speed in the combustion chamber is prevented from being accelerated and the heat generation rate is reduced and, consequently, the noise level becomes lowered. These phenomena undergone at engine idle occur not only at a warm-up drive but also at the time a drive under high load at high speed has switched over to an idle drive. Therefore, the present invention can advantageously be utilized as a countermeasure for noise produced at engine idle frequently carried out.

When the engine is changed over from its idle drive to a high-load high-speed drive, fuel of higher pressure than that at engine idle is fed under pressure from the feed pump 32 into the pump house 4. As a result, the pressure within the pump house 4 becomes high and the high pressure acts on the spool valve 21. For this reason, the spool valve 21 moves rightward in FIG. 2(*b*) against the restoring force of the spring 22 and stops up at its peripheral surface the openings of the communication aperture 17 and the connection aperture 18 to form a state of valve closure as shown in FIG. 2(*c*). In this state, therefore, even though part of the high pressure fuel is guided into the communication aperture 17 during the injection stroke of the plunger 8, it does not flow into the pump house 4 through the connection aperture 18 and the spill channel 19. In other words, the entire quantity of high pressure fuel is injected through the injection nozzle into the combustion chamber during the high-load high-speed drive of the engine and, therefore, the injection rate is maintained high and a high output can be generated. Therefore, even though both the plunger 8 and the valve shaft 26 move forward in synchronism with each other to open the pressure control valve 24 in the aforementioned engine drive state, the high pressure fuel within the communication aperture 17 can never flow into the pump house 4.

When the engine is switched over from it high-load high-speed drive to an idle drive, the pressure of the fuel fed under pressure from the feed pump 32 into the pump house 4 is lowered and, as a result, the pressure within the pump house 4 becomes substantially equal to that at the aforementioned idle drive and then acts on the spool valve 21. For this reason, the spool valve 21 is moved leftward in FIG. 2(*c*) by the restoring force of the spring 22 until the pressure within the pump house 4 and the restoring force of the spring 22 are counterbalanced as shown in FIG. 2(*b*). In this case, therefore, the communication aperture 17 is communicated with the connection aperture 18 through the control port 23 in the spool valve 21 and, during the injection stroke of the plunger 8, part of the high pressure fuel flows into the pump house 4 through the connection aperture 18 and the spill channel 19. Consequently, the injection rate is decreased to lower the noise level at engine idle. The noise level can further be lowered by increasing the variation in cross section of the pressure control valve 24 in its axial direction to form the variation characteristic of the opening area into a steep mountain-shaped characteristic, thereby causing the high pressure fuel to flow into the pump house 4 at the initial time of the injection stroke, making it possible to further delay the time of injection start and to shorten the injection time by the delayed time of injection start.

According to the injection rate controller of the present invention for a fuel injection pump, as described above, the injection rate can be lowered by accommodating the spool valve and the pressure control valve having its cross section contracted gradually in its axial direction respectively within the first and second valve ports formed in the pump housing, setting the first valve port so as to communicate with the high pressure chamber only under s specific condition of engine drive, reciprocating the pressure control valve in synchronism with the plunger, forming the spill channel in the fuel exhaust side of the second valve port so as to communicate with the pump house, guiding part of the high pressure fuel within the high pressure chamber into the first and second valve ports, and causing the guided fuel to flow into the pump house through the spill channel. Therefore, the noise level under a specific condition of engine drive, such as at engine idle for example, can be lowered. Further, since the spool valve and the pressure control valve which are principal components for controlling the injection rate are constructed as described above to make it possible to vary the fuel escape quantity in response to the displacement of the reciprocating plunger, the injection rate can stably be controlled with high reliability.

Furthermore, the injection rate controller of the present invention is easy to process, because complicated processing as in the conventional injection rate controllers is not required, and can be mass-produced. In addition, since the pressure control valve having its cross section contracted gradually in its axial direction fulfills its valve function in synchronism with the plunger and controls its opening area at the second valve port in response to the speed of the reciprocating plunger, the throttle effect is not lowered by either high or low speed of the reciprocating plunger and the injection rate can be controlled with exactitude in response to the speed of the reciprocating plunger.

What is claimed is:

1. An injection rate controller for a fuel injection pump comprising a pump housing, a hollow plunger barrel having a high pressure chamber, a plunger being reciprocative and rotatable within the hollow portion of the plunger barrel and having a cut-off port formed therein so as to communicate with the high pressure chamber, a control sleeve slidably attached to the plunger so as to open and close the cut-off port, and a pump house filled with a fuel oil, which injection rate controller comprises:

a first valve port formed in the pump housing so as to open to the pump house;

a communication aperture formed in the pump housing and adapted to connect said first valve port to the high pressure chamber;

a spool valve slidably accommodated within said first valve port so as to be displaceable in response to the pressure of fuel oil within the pump house and adapted to connect said first valve port to the high pressure chamber through said communication aperture only under a specific condition of engine drive, thereby introducing part of high pressure fuel within the high pressure chamber into said first valve port;

a second valve port formed in the pump housing so as to open to the pump house;

a connection aperture formed in the pump housing for connecting said second valve port to said first valve port;

a pressure control valve having its cross section contracted in its axial direction, accommodated within said second valve port so as to reciprocate in synchronism with the reciprocation of the plunger for opening and closing said second valve port; and a spill channel formed in the pump housing so as to connect said second valve port to the pump house for allowing high pressure fuel introduced from said first valve port to said second valve port through said connection aperture flow therethrough into the pump house only under said specific condition of engine drive, the amount of the high pressure fuel flowing from said second valve port into the pump house through said spill channel being variable by the amount of displacement of said pressure control valve.

2. An injection rate controller according to claim 1, wherein said specific condition of engine drive is engine idle.

3. An injection rate controller according to claim 1, wherein said first valve port has a magnet coil fitted around the bottom portion thereof and excited only under a specific condition of engine drive to attract and displace said spool valve.

4. An injection rate controller according to claim 3, wherein said specific condition of engine drive is engine idle.

5. An injection rate controller according to claim 1, wherein said spool valve has an integral connection lever projecting toward the side of the pump house and connected to a control lever interlocked with an axle pedal or a governor lever moved in response to the rotation speed of the injection pump, is displaced by the control lever or the governor lever, and is displaced to connect said first valve port to the high pressure chamber through said communication aperture only under a specific condition of engine drive.

6. An injection rate controller according to claim 5, wherein said specific condition of engine drive is engine idle.

* * * * *